US007377587B1

(12) United States Patent
Guillot

(10) Patent No.: US 7,377,587 B1
(45) Date of Patent: May 27, 2008

(54) HINGED GLIDER MECHANISM

(75) Inventor: Edmond P. Guillot, Conover, NC (US)

(73) Assignee: Hickory Springs Manufacturing Company, Hickory, NC (US)

( * ) Notice: Subject to any disclaimer, the term of this patent is extended or adjusted under 35 U.S.C. 154(b) by 391 days.

(21) Appl. No.: 10/887,177

(22) Filed: Jul. 8, 2004

(51) Int. Cl.
*A47C 3/02* (2006.01)
*E05D 5/00* (2006.01)

(52) U.S. Cl. ..... 297/259.3; 297/258.1; 16/385

(58) Field of Classification Search ..... 297/259.3, 297/258.1, 259.1, 272.1, 463.1, 270.1; 16/385, 16/378, 221
See application file for complete search history.

(56) References Cited

U.S. PATENT DOCUMENTS

| | | | | |
|---|---|---|---|---|
| 81,282 | A | 8/1868 | Mareau | |
| 83,644 | A | 11/1868 | Leidecker et al. | |
| 144,603 | A | 11/1873 | Enger | |
| 195,395 | A | 9/1877 | Pope | |
| 991,334 | A | 5/1911 | Magee | |
| 2,142,714 | A | 1/1939 | Campbell | |
| 2,487,249 | A | 11/1949 | Krasberg | 272/52 |
| 2,646,838 | A | 7/1953 | Welsh | 155/11 |
| 2,869,619 | A | 1/1959 | Petersen et al. | 155/107 |
| 3,054,639 | A | 9/1962 | Schliephacke | 297/89 |
| 3,096,118 | A | 7/1963 | Dubeck | 297/75 |
| 3,243,225 | A | 3/1966 | Katz | 297/75 |
| 3,730,585 | A | 5/1973 | Rogers, Jr. et al. | 297/85 |
| 3,815,954 | A | 6/1974 | Rogers, Jr. et al. | 297/271 |
| 3,926,472 | A | 12/1975 | Evans | 297/88 |
| 4,291,913 | A | 9/1981 | Kowalski | 297/89 |
| 4,353,146 | A * | 10/1982 | Brockhaus | 16/387 |
| 4,368,559 | A * | 1/1983 | Oepping et al. | 16/386 |
| 4,437,701 | A | 3/1984 | Mizelle | 297/85 |
| 4,519,647 | A | 5/1985 | Rogers, Jr. | 297/85 |
| 4,536,029 | A | 8/1985 | Rogers, Jr. | 297/281 |
| 4,544,201 | A | 10/1985 | Rogers, Jr. | 297/271 |
| 4,601,513 | A | 7/1986 | Pine | 297/270 |
| 4,700,920 | A | 10/1987 | Horn | 248/370 |
| 5,103,532 | A * | 4/1992 | Youngdale et al. | 16/288 |
| 5,110,182 | A * | 5/1992 | Beauvais | 297/216.11 |
| 5,129,701 | A | 7/1992 | Pine | 297/68 |
| 5,344,214 | A | 9/1994 | Trent | 297/270 |
| 5,375,914 | A * | 12/1994 | Donnelly | 297/335 |
| 5,427,433 | A | 6/1995 | Holobaugh, Jr. | 297/273 |

(Continued)

FOREIGN PATENT DOCUMENTS

DE 35 24 056 A1 1/1987

(Continued)

*Primary Examiner*—Milton Nelson, Jr.
(74) *Attorney, Agent, or Firm*—Kennedy Covington Lobdell & Hickman, LLP

(57) ABSTRACT

A hinged glider mechanism includes a hinge device for pivoted mounting in a chair between a stationary base frame and a seat frame, for supporting the seat frame for oscillatory gliding motion generally longitudinally relative to the base frame. The hinge device is configured for repeated substantially silent pivotal oscillating cycles over an extended life. The hinge device includes a hinge panel consisting essentially of a polymeric material, such as acetal copolymer, that is characterized by a sufficient strength and durability to support the seat frame and a seat occupant during repeated and extended pivotal oscillating cycles without failure and a sufficient lubricity not to generate noise during the repeated and extended pivotal oscillating cycles.

20 Claims, 3 Drawing Sheets

U.S. PATENT DOCUMENTS

| | | | | | |
|---|---|---|---|---|---|
| 5,515,561 | A | * | 5/1996 | Suggitt et al. | 5/607 |
| 5,568,820 | A | * | 10/1996 | Dirksing | 132/315 |
| 5,611,602 | A | * | 3/1997 | Brady | 297/452.23 |
| 5,704,686 | A | | 1/1998 | May | 297/281 |
| 5,765,913 | A | | 6/1998 | LaPointe et al. | 297/281 |
| 6,092,870 | A | | 7/2000 | Desnoyers et al. | 297/281 |
| 6,120,095 | A | | 9/2000 | Rogers | 297/273 |
| 6,901,633 | B2 | * | 6/2005 | Chen | 16/240 |

FOREIGN PATENT DOCUMENTS

| | | |
|---|---|---|
| DE | 91 15 439.1 | 5/1992 |
| FR | 818.343 | 6/1937 |
| WO | WO 97/14336 | 4/1997 |
| WO | WO 97/39662 | 10/1997 |
| WO | WO 98/16137 | 4/1998 |

* cited by examiner

HINGED GLIDER MECHANISM

FIELD OF THE INVENTION

The present invention relates to an improved hinged mechanism for a glider chair.

BACKGROUND OF THE INVENTION

The rocking chair is a staple of Americana that is well known to those skilled in the art of chair making. A gentle rocking motion is considered by most people to add pleasure and comfort to the otherwise ordinary act of sitting, and a number of early innovations in chair making were directed to carrying out various kinds of motion. With the advent of moving chairs that rely upon moving parts to produce a rocking motion, as opposed to a true rocking chair with its familiar arching runners, a significant degree of complexity was required to a rocking motion. Generally, a set of complicated linkages has been necessary to produce the desired motion while maintaining a sufficient degree of support for the chair.

In modern moving chairs of the general class to which the present invention is directed, the arc of motion falls mostly into one of two categories: rockers, characterized by a pivoting motion analogous to a traditional rocking chair, and gliders, to which the present invention is directed, characterized by a reciprocating, front-and-back motion that lacks a vertical or pivoting component.

Complicated linkages have proven to be suitable for providing support for gliders while enabling the gliding motion, because the complexity of the linkage permits lighter-weight materials to be used without compromising support, which in turn reduces the weight of the gliding chair unit. However, the attendant and inherent difficulty associated with a complex linkage is that the greater the number of moving parts in a machine, the greater the number of opportunities for the failure of parts. Because chairs of this type are typically quite expensive, it is highly desirable to have a gliding mechanism that is less likely to fail, even after periods of prolonged use.

In addition to the potential for breakage and failure in a complicated linkage, a complicated linkage provides more opportunities for noisy operation, because the number of joints is large, and each joint may produce noise when operating under loaded motion. The presence of a repetitive and persistent noise during the gliding operation of the chair substantially reduces the desirability of the chair, because such noise is bothersome and defeats the primary purpose of a chair of this type-relaxation. Particularly over a large number of cycles and under loaded conditions, the moving parts of a complicated linkage, even if well lubricated, still involve metal parts rubbing over other metal parts. The resulting noise is likely to force substantially higher repair and maintenance costs over the life of the chair.

One approach for resolving these issues is to substitute a living hinge, made of nylon, for the complicated linkage, in order to facilitate a gliding motion. This approach is illustrated in U.S. Pat. No. 6,120,095, the disclosure of which is incorporated herein by reference. Although the complexity of the linkage is consequently reduced by the use of a living hinge, such an approach depends upon the long-term stability of the living hinge for operability. Those skilled in the art will recognize that such dependence might be misplaced, because the constant and repetitive stress on such a hinge, which is weakened by definition, may cause the living hinge to fail catastrophically after, for instance, one million gliding cycles.

What is needed, then, is a glider mechanism that avoids the problems inherent in a complicated linkage by reducing the complexity of the linkage and by employing materials that are substantially silent during operation, but that overcomes the problems associated with the use of living hinges by employing materials of substantially greater strength and reliability.

SUMMARY OF THE INVENTION

Based on the foregoing needs, it is therefore an object of the present invention to provide a hinged mechanism for supporting a glider chair in an improved, simplified manner, that is substantially silent in operation and sufficiently durable to maintain the desired characteristics of operability over long-term use under significant loads.

The present invention therefore provides a hinge device for pivoted mounting in a chair between a stationary base frame and a seat frame. The seat frame supports a seat and exhibits an oscillatory gliding motion generally longitudinally relative to the base frame. The hinge device of the present invention is configured for repeated, substantially silent pivotal oscillating cycles over an extended life. The hinge device includes a hinge panel that consists essentially of a polymeric material characterized by a sufficient strength and durability to support the seat frame, the seat, and a seat occupant during repeated and extended pivotal oscillating cycles without failure, and by a sufficient lubricity not to generate noise during the repeated and extended pivotal oscillating cycles.

In a preferred embodiment, the polymeric material is an acetal copolymer, or an acetal copolymer mixed with a silicone lubricant.

The hinge device of the present invention is in a preferred embodiment connected at its ends to both the seat frame and the base frame, and the nature of this connection is such that the hinge device rotates at both ends about axes running generally perpendicularly to the oscillation direction. In order to facilitate the connection, either of the frames may be provided with attachment ears to be connected to a permanent or non-permanent pin-type connector that forms the axis of rotation for the hinge device.

In another feature of the present invention, the hinge device is provided with one or more means for limiting the range of oscillation, such as a lip, which is configured to engage the frame in order to stop the hinge device from rotating beyond an established line of demarcation, principally in order to prevent unwanted relative motion of the frames when the hinge device is in an unloaded condition (such as when it is lifted to be moved).

The present invention also provides a glider base structure for supporting a chair for generally longitudinal oscillatory gliding motion. The glider base structure includes a base frame that has spaced front and back base rails that are disposed transversely to the longitudinal or gliding direction. The base structure also includes a seat frame that has spaced front and back chair rails that are disposed inwardly of the base rails and are likewise transverse to the gliding direction. The seat frame is adapted for attachment of a seat structure to the seat frame.

The glider base structure of the present invention also includes at least one front hinge device and at least one back hinge device, each pivotally connected between the front base and chair rails and the back base and chair rails, respectively. The hinge devices therefore support the seat frame for a range of oscillatory gliding motion generally longitudinally relative to the base frame, the motion being defined by the pivotability of the hinge devices. Each hinge device is configured for repeated, substantially silent pivotal oscillating cycles over an extended life, each hinge device including a hinge panel consisting essentially of a polymeric material. The polymeric material is characterized by a sufficient strength and durability to support the seat structure, the seat frame, and a seat occupant during repeated and extended pivotal oscillating cycles without failure, and by a sufficient lubricity not to generate noise during the repeated and extended pivotal oscillating cycles.

As discussed previously, the polymeric material is preferred to be an acetal copolymer, either alone or mixed with a silicone lubricant. Also, the hinge device may include at least one lip for engaging one of the rails in order to prevent undesired displacement of the base frame with respect to the chair frame under unloaded conditions.

Additionally, the present invention provides a chair adapted for oscillatory gliding motion in a desired longitudinally direction. The chair includes a seat structure for supporting an occupant in a seated position and a glider base structure. The glider base structure includes a base frame with spaced front and back base rails disposed transversely to the gliding direction, a seat frame with spaced front and back chair rails disposed inwardly of the base rails and transversely to the gliding direction, with the seat structure being affixed to the seat frame. The glider base structure also includes at least one front and at least one back hinge device, the front hinge device being pivotally connected between the front base rail and the front chair rail, and the back hinge device being pivotally connected between the back base rail and the back chair rail.

The hinge devices support the seat frame for a range of oscillatory gliding motion, generally longitudinally relative to the base frame, and defined by the pivotability of the hinge devices. Each of the hinge devices is configured for repeated substantially silent pivotal oscillating cycles over an extended life and includes a hinge panel that consists essentially of a polymeric material that is characterized by a sufficient strength and durability to support the seat structure, the seat frame, and a seat occupant during repeated and extended pivotal oscillating cycles without failure, and by a sufficient lubricity not to generate noise during the repeated and extended pivotal oscillating cycles.

BRIEF DESCRIPTION OF THE DRAWINGS

Further features, embodiments, and advantages of the present invention will become apparent from the following detailed description with reference to the drawings, wherein.

DETAILED DESCRIPTION OF THE PREFERRED EMBODIMENTS

Figure 1:
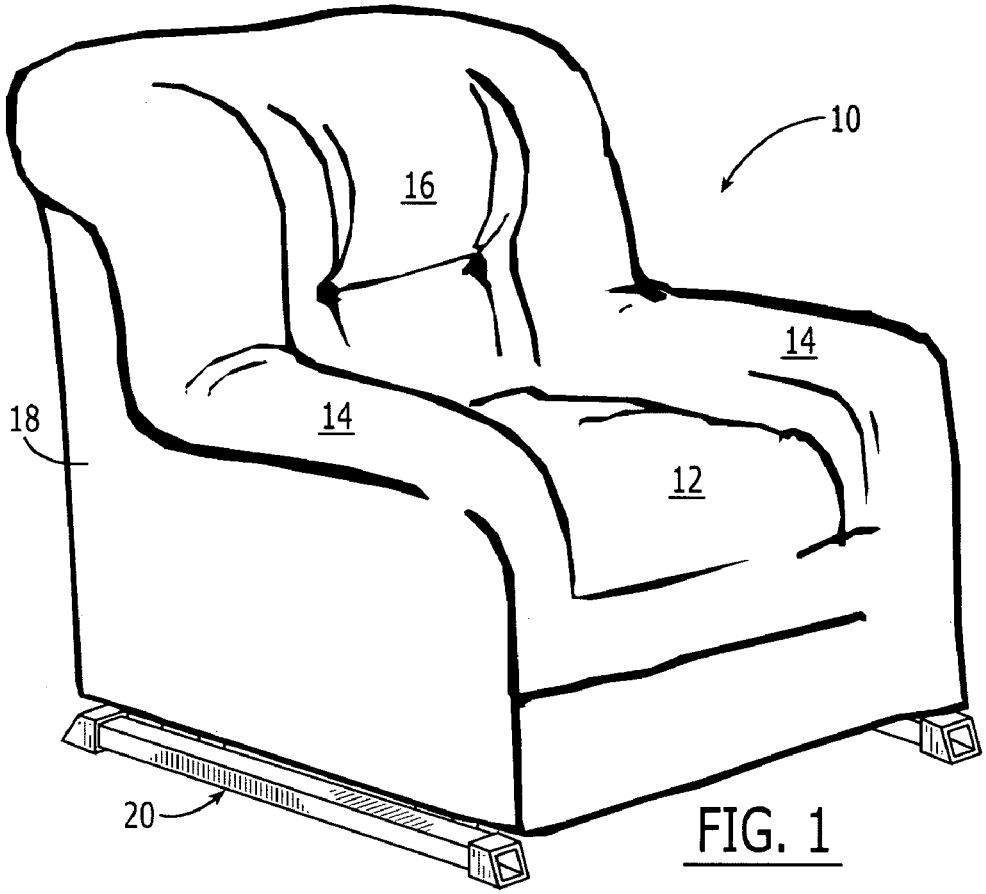
FIG. 1 is a general perspective view showing a chair according to the present invention.

Referring now to the drawings, FIG. 1 illustrates a chair 10 according to the present invention in a general perspective view. The chair 10 is of the upholstered type typically found in a home and includes a plush sitting surface 12, arms 14, and a back support 16, all of which together form a seat structure 18, and all of which may be configured with a wide range of desired features outside the purview of the present invention and all well within the skill of those skilled in the present art. The chair 10 is provided with a glider base structure 20, which serves to support the seat structure 18 and an occupant (not shown) in a seated position and through a range of oscillatory longitudinal motion known as gliding. The base structure 20 will be discussed in greater detail in connection with FIG. 2 and other drawings.

Although a plush, upholstered-style chair 10 is shown in FIG. 1, the present invention is capable of adaptation for use with a wide variety of other styles of chairs and seats, and it will be recognized that the present invention will be useful in any chair or seat application in which a gliding motion is desired.

Figure 2:
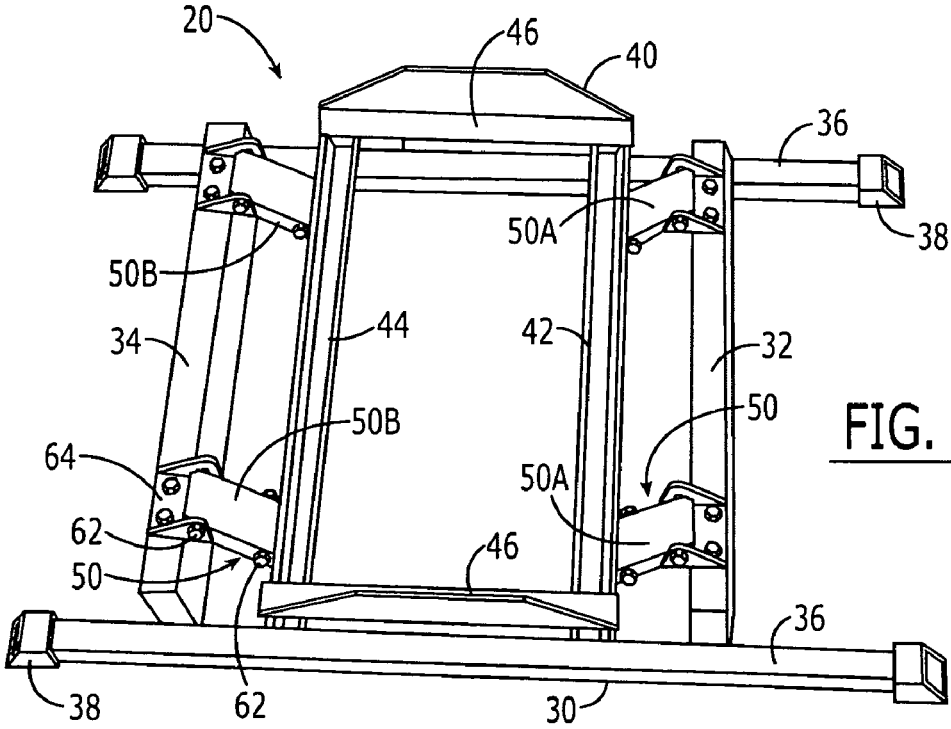
FIG. 2 is a perspective view of a glider base structure according to the present invention.
Figure 3:
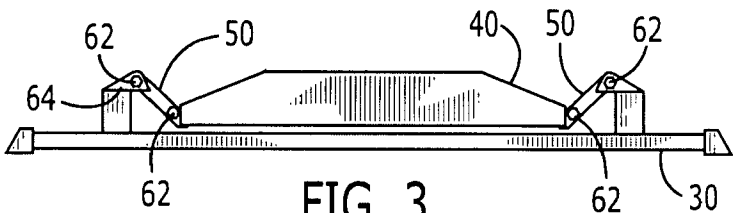
FIG. 3 is a side view of a glider base structure as in FIG. 2.

Referring now to FIGS. 2 and 3, a glider base structure 20 is shown in a perspective view in greater detail than in FIG. 1. The glider base structure 20 is adapted to support a seat structure 18 (see FIG. 1) for generally longitudinal oscillatory gliding motion, indicated by arrow A. The glider base structure 20 includes a base frame 30 and a seat frame 40. The base frame 30 has a front base rail 32 and a back base rail 34, the base rails 32,34 being spaced apart and disposed transversely to the gliding direction. The seat frame 40 is likewise provided with a front chair rail 42 and a back chair rail 44, the chair rails 42,44 being spaced apart and disposed transversely to the gliding direction A. Relative to the base rails 32,34, the chair rails 42,44 are disposed at a lesser spacing to one another to be disposed inwardly of the base rails 32,34, and in the preferred embodiment shown in FIGS. 2 and 3, the seat frame 40 is designed to hang within the base frame 30 in a manner to be described in greater detail below.

In addition to the base rails 32,34, the base frame 30 is ideally provided with other structure sufficient to form a sturdy base for the chair 10, such as longitudinal rails 36 and feet 38. Also, the seat frame is ideally provided with other structure sufficient to enable the support and attachment of the chair 10 thereto, such as longitudinal rails 46. The particular structure of the base frame 30 and the seat frame 40 will be governed primarily by the design choices established by the characteristics of the chair 10 to be supported thereon.

In order to connect the base frame 30 to the seat frame 40, front and back hinges 50A,50B are provided. The composition and characteristics of these hinges 50A,50B will be discussed in greater detail below. As can be seen in FIG. 2, the front hinges 50A are pivotally connected on the ends thereof between the front base rail 32 and the front chair rail 42, and the back hinges 50B are pivotally connected on the ends thereof between the back base rail 34 and the back chair rail 44. Although it is possible to use only a single front hinge 50A and a single back hinge 50B, for reasons of stability and durability it is preferred to use two or more hinges 50A in the front and two or more hinges SOB in the back.

The hinge devices 50 are arranged to support the weight of the seat frame 40 (plus any seat structure 18 and occupant or other contents desired to be supported thereon) in a manner that permits a range of oscillatory gliding motion that is along a line that is generally in a mostly horizontal direction perpendicular to the axes of rotation of the hinge devices 50; the oscillatory gliding motion is defined by the pivotability of the hinge devices 50.

The hinge devices 50 are generally all configured the same, but in some embodiments it may be useful to employ a longer or shorter hinge 50 in the front or the rear, depending on the desired characteristics of the gliding motion and of the chair 10 itself.

In a preferred embodiment, each of the hinge devices 50 is configured for repeated and substantially silent pivotal oscillating cycles over an extended life, and both the material from which the hinge devices 50 are made and the structural configuration of the hinge devices 50 contribute the preferred configuration and operation of the hinge devices 50.

Figure 5:
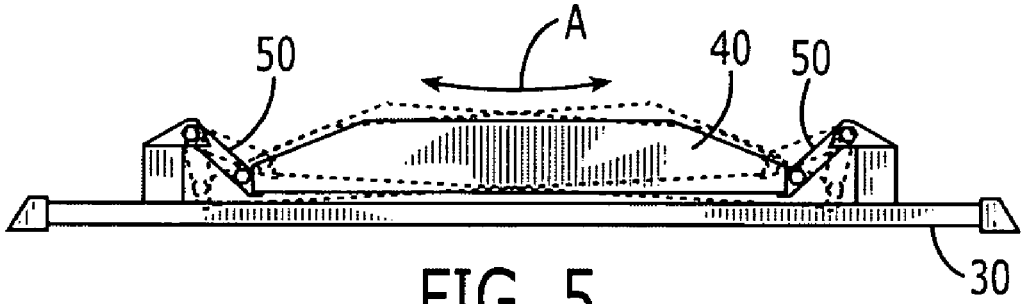
FIG. 5 is a detailed side view showing a device according to the present invention in gliding condition.

Referring now to FIGS. 3 and 5, the glider base structure 20 of the present invention is shown in a side detail view, with the direction of oscillation symbolized by arrow A. The glider base includes a stationary base frame 30 that has a front base rail 32 and a back base rail 34 rigidly affixed in spaced apart relation between longitudinal side rails 36 supported on feet 38 so as to provide adequate support for the entire chair 10 (see FIG. 1). The glider base also includes a moving seat frame 40 that includes front chair rail 42 and back chair rail 44, rigidly affixed at a more narrow spacing between longitudinal side rails 46, whereby the seat frame 40 is disposed between or interiorly of the base rails 32,34. As can be seen in the figure, the seat frame 40 is configured to rest below the plane formed by the top of the base frame 30.

Figure 4:
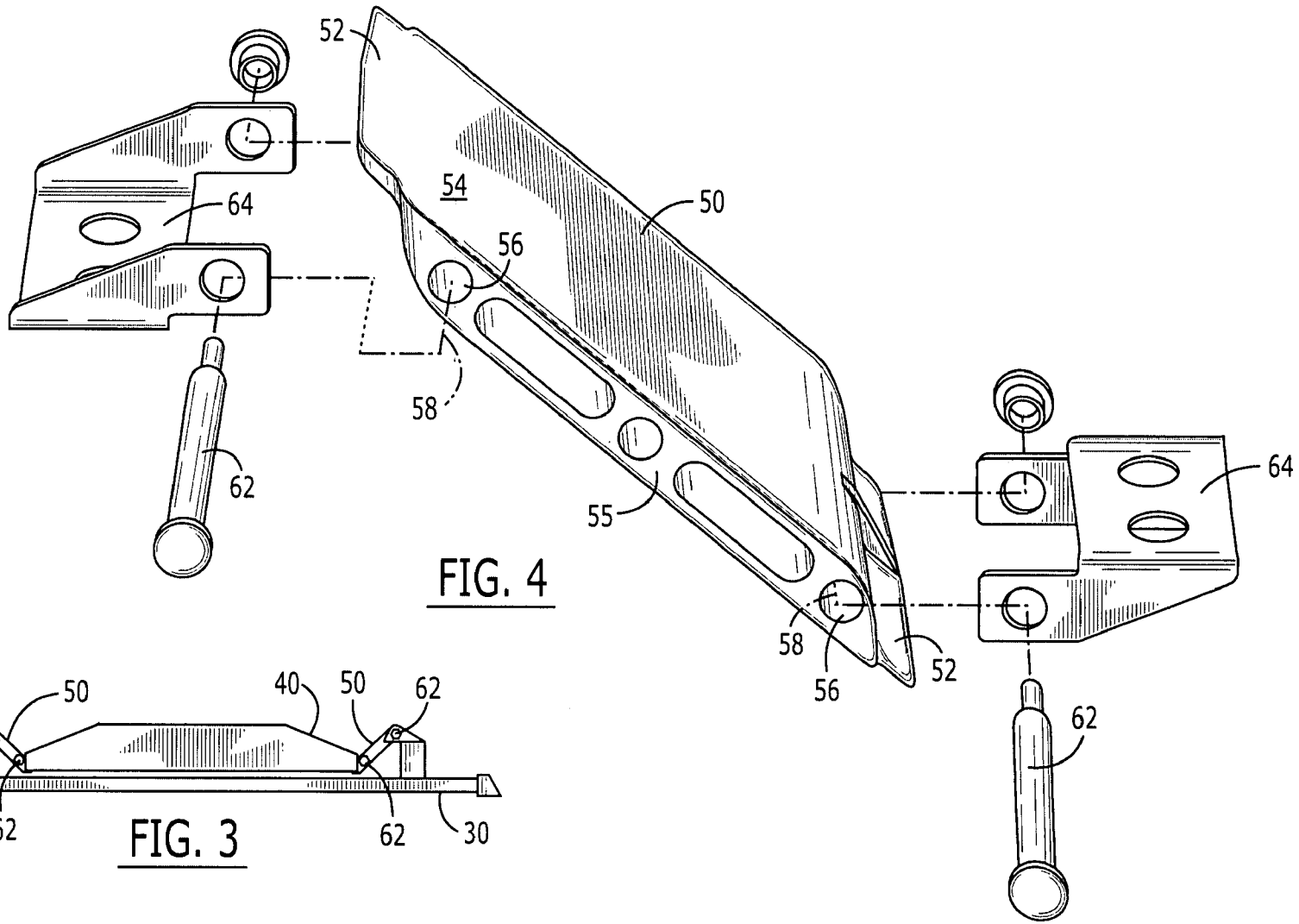
FIG. 4 is a detailed perspective view of a hinge according to the present invention.

The seat frame 40 is connected to the base frame 30 and is supported in that connection by a set of hinge devices 50, which include at least one and preferably a pair of front hinge devices 50A and at least one and preferably a pair of back hinge devices 50B, which provide support for the seat frame 40 while also permitting the seat frame 40 to oscillate back and forth in the direction of arrow A within a range of oscillatory gliding motion. The range of motion is defined by the pivotability of the hinge devices 50. Also as can be seen in FIG. 4, each of the hinge devices 50 may be provided with lips 52 at either end; in a preferred embodiment, these lips 52 define outer limits for the pivotability of the hinge devices 50. Additionally, the pivotability of the hinge devices 50 is intrinsically limited by their arrangement within the glider base 20. Specifically, the longitudinal forward motion of the front hinges 50A is opposed by a limit of longitudinal forward motion defined by the length of the back hinges 50B, and likewise, the longitudinal backward motion of the back hinges 50B is opposed by a limit of longitudinal backward motion defined by the length of the front hinges 50A. This inherent limitation on motion enables a smooth gliding motion of the seat 10 in a manner which is primarily not limited by the striking of one part of the device upon another part, and, particularly, normal gliding motion does not ordinarily generate contact with the lips 52 of the hinge devices 50.

A preferred embodiment of the hinge devices 50 is illustrated in even greater detail in connection with FIG. 4, and those skilled in the art to which the present invention relates will recognize that a more detailed discussion of the composition and structure of the hinge devices is necessary for a full understanding of the operation of devices according to the present invention.

The preferred material of the hinge devices 50 is a polymeric material that is in the first instance characterized by sufficient strength and durability to support, without failure, the seat structure 18, the seat frame 40, and the occupant, or any other tolerable load placed thereon, over a period of extended, long-term use during which the chair experiences repeated and extended pivotal oscillating cycles. Also, the polymeric material is characterized by a sufficient lubricity that the hinges do not generate noise during repeated and extended pivotal oscillating cycles. In a preferred embodiment, the polymeric material is an acetal copolymer. In a most preferred embodiment, the polymeric material is an acetal copolymer that has been admixed with approximately 2% silicone lubricant. The ratio of acetal copolymer to silicone lubricant may of course be varied depending upon the tolerances and desired performance of the hinges, the primary consideration being striking a balance between the need for lubrication and the need for structural stability and durability, which has not been found to be possible with alternative known materials such as nylon.

Acetal is preferred over other materials because of its physical properties. It exhibits a high melting point and a high modulus of elasticity, while featuring great strength, stiffness, and resistance to abrasion. Additionally, acetal features a high degree of dimensional stability as well as a great deal of natural lubricity. Overall, the use of acetal, or of acetal with a silicone lubricant additive, permits devices constructed according to the present invention to meet the goals discussed at the outset by providing sufficient support for the seat while permitting substantially silent operation, even over hundreds of thousands or even in excess of one million oscillations under load.

As seen in FIG. 4, the hinge device 50, and more particularly the hinge panel 54 that forms the primary body member of the hinge device 50, is in a preferred embodiment a flat, generally rectangular molded member having a number of novel features. The main body 55 of the hinge panel 54 is rigid and has been molded into a structure that features substantial stability and strength against stresses placed thereon in the direction of arrow B. The particular configuration of the main body 55 will vary depending upon the strength characteristics desired and on the design of the chair system 10, but in a preferred embodiment has at each end an aperture 56 that extends laterally through the entire width of the main body 55. These apertures 56 form the axes of rotation 58 about which the hinge devices 50 rotate to define the range of pivotal oscillating motion.

The hinge panel 54 may also be provided at each end with a lip 52, the purpose of which will become clearer when discussed in connection with FIG. 6. The lips 52 are disposed such that they extend from opposite faces of the hinge panel 54. As can be seen in FIG. 4, these lips extend beyond the axis of rotation 58.

As further depicted in FIG. 4, in addition to the hinge panel 54 identified above, the hinge device 50 according to the present invention is provided in a preferred embodiment with hinge pins 62 which may be connected to the rails 32,34,42,44 by means of attachment ears 64 or another suitable means for connecting to the rails. Those skilled in the art will recognize that the use of a pin 62 is intended to be an example and not a limitation upon the type of attachment. A permanent connector, such as a rivet or a non-removable pin, or a non-permanent connector, such as a bolt or a removable pin, or indeed any other suitable type of connector, could be used as the axis about which the hinge panel rotates. Preferably, the connector will be selected based upon its ability to provide sufficient strength to support the chair 10 without impinging upon the range of motion of the hinge device 50.

Figure 6:
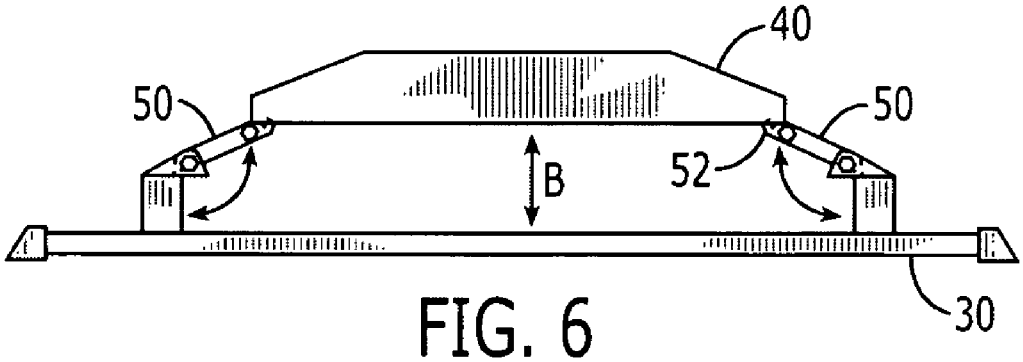
FIG. 6 is a detail side view showing a device according to the present invention in an unloaded condition.

Referring now to FIG. 6, a glider base according to the present invention is shown in a perspective view to illustrate the function of the lips 52 noted above. When the chair 10 (see FIG. 1) is lifted, such as for moving, and thereby placed into a lifted, unloaded condition, there may be sufficient freedom within the hinges to permit the seat frame 40 to move above the base frame 30. In the absence of the lips 52, the base frame would be considerably freer to move, and in an unwanted fashion, because there would be essentially no restrictions upon the motion of the base frame. Whereas during gliding, motion of the seat frame 40 relative to the base frame 30 is desirable and intended, a similar movement of the base frame 30 relative to the seat frame 40 when the chair 10 is being moved is undesirable and potentially dangerous.

In a preferred embodiment, therefore, the lips 52 are arranged upon the hinge plate 54 in such a location that when the seat frame 40 is raised above the plane formed by the top of the base frame 30, the lips 52 strike their respective rails 32,34,42,44, and the motion of the base frame 30 with respect to the seat frame 40 is prevented. Gravity naturally keeps the base frame 30 in this non-moving position as long as the orientation of the chair 10 is maintained upright.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof

What is claimed is:

1. A hinge device for pivoted mounting in a chair between a stationary base frame and a seat frame for supporting the seat frame for oscillatory gliding motion generally longitudinally relative to the base frame, the hinge device comprising:

a hinge panel consisting essentially of a polymeric material characterized by a sufficient strength and durability to support the seat frame and a seat occupant during repeated and extended pivotal oscillating cycles without failure and a sufficient lubricity not to generate noise during the repeated and extended pivotal oscillating cycles, the hinge panel having opposite ends respectively forming hinge locations, a pair of separate attachment ears for attaching the hinge device to the frames, each attachment ear being selectively configured to attach respectively to the opposite ends of the hinge panel, and a pair of connectors, each forming a pivot for the hinge device and facilitating the connection between each hinge location at the opposite ends of the hinge panel and a respective attachment ear, wherein the hinge device is configured for repeated substantially silent pivotal oscillating cycles over an extended life.

2. A hinge device for pivoted mounting in a chair between a stationary base frame and a seat frame for supporting the seat frame for oscillatory gliding motion generally longitudinally relative to the base frame, the hinge device being configured for repeated substantially silent pivotal oscillating cycles over an extended life, the hinge device comprising a hinge panel consisting essentially of a polymeric material characterized by a sufficient strength and durability to support the seat frame and a seat occupant during repeated and extended pivotal oscillating cycles without failure and a sufficient lubricity not to generate noise during the repeated and extended pivotal oscillating cycles, wherein the polymeric material comprises a silicone lubricant mixed with an acetal copolymer.

3. A hinge device according to claim 2, further comprising:

a connector for connecting the hinge device to the frames, the connector forming a pivot for the hinge device.

4. A hinge device according to claim 2, further comprising:

means for limiting a range of the pivotal oscillating cycles.

5. A hinge device according to claim 4, wherein the means for limiting comprises at least one lip configured to engage one of the frames.

6. A hinge device according to claim 2, further comprising:

attachment ears for attaching the hinge device to the frames.

7. In combination, a hinge device for pivoted mounting in a chair between a stationary base frame and a seat frame for supporting the seat frame for oscillatory gliding motion generally longitudinally relative to the base frame, the hinge device being configured for repeated substantially silent pivotal oscillating cycles over an extended life, the hinge device comprising a hinge panel consisting essentially of a polymeric material characterized by a sufficient strength and durability to support the seat frame and a seat occupant during repeated and extended pivotal oscillating cycles without failure and a sufficient lubricity not to generate noise during the repeated and extended pivotal oscillating cycles, and a glider base structure for supporting a chair for generally longitudinal oscillatory gliding motion, the glider base structure comprising:

a base frame having spaced front and back base rails disposed transversely to a gliding direction;

a seat frame having spaced front and back chair rails disposed inwardly of the base rails and transversely to the gliding direction, the seat frame being adapted for attachment of a seat structure thereto;

the hinge device comprising:

at least one front hinge device pivotally connected between the front base rail and the front chair rail;

at least one back hinge device pivotally connected between the back base rail and the back chair rail;

the hinge devices supporting the seat frame for a range of oscillatory gliding motion generally longitudinally relative to the base frame defined by the pivotability of the hinge devices.

8. The combination of a hinge device and a glider base structure according to claim 7, further comprising:

a set of connectors for connecting the hinge devices to the rails, the set of connectors forming a pivot for the hinge device.

9. The combination of a hinge device and a glider base structure according to claim 7, wherein the polymeric material is an acetal copolymer.

10. The combination of a hinge device and a glider base structure according to claim 7, wherein the polymeric material is an acetal copolymer mixed with a silicone lubricant.

11. The combination of a hinge device and a glider base structure according to claim 7, wherein the hinge devices each include at least one lip for engaging one of the rails to prevent undesired displacement of the base frame with respect to the seat frame under unloaded conditions.

12. The combination of a hinge device and a glider base structure according to claim 7, further comprising:

a set of attachment ears for attaching the hinge devices to the rails.

13. In combination, a hinge device for pivoted mounting in a chair between a stationary base frame and a seat frame for supporting the seat frame for oscillatory gliding motion generally longitudinally relative to the base frame, the hinge device being configured for repeated substantially silent pivotal oscillating cycles over an extended life, the hinge device comprising a hinge panel consisting essentially of a polymeric material characterized by a sufficient strength and durability to support the seat frame and a seat occupant during repeated and extended pivotal oscillating cycles without failure and a sufficient lubricity not to generate noise during the repeated and extended pivotal oscillating cycles and a chair adapted for oscillatory gliding motion in a desired longitudinal direction, the chair comprising:

a seat structure for supporting an occupant in a seated position;

a glider base structure comprising:

a base frame having spaced front and back base rails disposed transversely to a gliding direction;

a seat frame having spaced front and back chair rails disposed inwardly of the base rails and transversely to the gliding direction, the seat structure being affixed to the seat frame;

the hinge device comprising:

at least one front hinge device pivotally connected between the front base rail and the front chair rail;

at least one back hinge device pivotally connected between the back base rail and the back chair rail;

the hinge devices supporting the seat frame for a range of oscillatory gliding motion generally longitudinally relative to the base frame defined by the pivotability of the hinge devices.

14. The combination of a hinge device and a chair according to claim 13, comprising at least two front hinge devices and at least two back hinge devices.

15. The combination of a hinge device and a chair according to claim 13, wherein the polymeric material is an acetal copolymer.

16. The combination of a hinge device and a chair according to claim 13, wherein the polymeric material is an acetal copolymer mixed with a silicone lubricant.

17. The combination of a hinge device and a chair according to claim 13, further comprising:

a set of attachment ears for attaching the hinge devices to the rails.

18. The combination of a hinge device and a chair according to claim 13, wherein each of the hinge panels rotates about axes disposed at each end thereof according to a position of the seat frame within the range of oscillatory gliding motion.

19. The combination of a hinge device and a chair according to claim 13, wherein the at least one front hinge device has a length different from a length of the at least one back hinge device.

20. The combination of a hinge device and a chair according to claim 19, wherein the at least one front hinge device is longer than the at least one back hinge device.

* * * * *